US005618120A

United States Patent [19]

Ishikawa

[11] Patent Number: 5,618,120

[45] Date of Patent: Apr. 8, 1997

[54] RECORDING APPARATUS HAVING MEANS FOR DETECTING THE POSITIONS OF A RECORDING MEDIUM

[75] Inventor: Eiji Ishikawa, Yokohama, Japan

[73] Assignee: Canon Kabushiki Kaisha, Tokyo, Japan

[21] Appl. No.: 293,419

[22] Filed: Aug. 22, 1994

Related U.S. Application Data

[63] Continuation of Ser. No. 918,046, Jul. 24, 1992, abandoned.

[30] Foreign Application Priority Data

Jul. 29, 1991 [JP] Japan ..... 3-210484

[51] Int. Cl.[6] ..... B41J 29/42

[52] U.S. Cl. ..... 400/708; 400/74

[58] Field of Search ..... 400/708, 711, 400/50, 74

[56] References Cited

U.S. PATENT DOCUMENTS

| | | | |
|---|---|---|---|
| 4,265,556 | 5/1981 | Krieg et al. | 400/342 |
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,591,871 | 5/1986 | Ohta | 400/708 |
| 4,639,607 | 1/1987 | Brandner | 250/561 |
| 4,723,129 | 2/1988 | Endo et al. | 346/1.1 |
| 4,740,796 | 4/1988 | Endo et al. | 346/1.1 |
| 4,778,296 | 10/1988 | Takahashi | 400/708 |
| 4,795,999 | 1/1989 | Takahashi et al. | 400/708 |
| 4,934,845 | 6/1990 | Kato | 400/708 |
| 4,983,854 | 1/1991 | Mizuno et al. | 400/708 |
| 5,127,752 | 7/1992 | Courtney | 400/708 |
| 5,150,977 | 9/1992 | Yoshikawa | 400/708 |
| 5,486,063 | 1/1996 | Fox et al. | 400/708 |

FOREIGN PATENT DOCUMENTS

| | | | |
|---|---|---|---|
| 0266209 | 10/1987 | European Pat. Off. | 400/708 |
| 54-56847 | 5/1979 | Japan | 400/126 |
| 56-150556 | 11/1981 | Japan | 400/126 |
| 59-123670 | 7/1984 | Japan | 400/126 |
| 59-138461 | 8/1984 | Japan | 400/126 |
| 60-71260 | 4/1985 | Japan | 400/126 |
| 179888 | 9/1985 | Japan | 400/719 |
| 1228880 | 9/1989 | Japan | 400/708 |
| 107954 | 5/1991 | Japan | 400/708 |

OTHER PUBLICATIONS

IBM Technical Disclosure Bulletin, vol. 30, No. 4, Sep. 1987, pp. 1894–1895, "Form Detection Mechanism On A Serial Printer".

Patent Abstracts of Japan, vol. 13, No. 555 (M–904), Dec. 11, 1989.

*Primary Examiner*—Edgar S. Burr
*Assistant Examiner*—Steven S. Kelley
*Attorney, Agent, or Firm*—Fitzpatrick, Cella, Harper & Scinto

[57] ABSTRACT

A recording apparatus having means for detecting a recordable area on a recording medium comprises the structures of measuring means capable of measuring the reflective luminous energy of a recording medium and of means for holding the recording medium, means for holding the data on the basis of the reflective luminous energy of the means for holding the recording medium and the data on the basis of the reflective luminous energy of the recording medium, which are measured by the measuring means, and means for setting by both of the data a threshold value utilized for determining the boundary between the recording medium and the means for holding the medium.

7 Claims, 4 Drawing Sheets

RECORDING APPARATUS HAVING MEANS FOR DETECTING THE POSITIONS OF A RECORDING MEDIUM

This application is a continuation of application Ser. No. 07/918,046, filed Jul. 24, 1992, now abandoned.

BACKGROUND OF THE INVENTION

1. Field of the Invention

The present invention relates to a recording apparatus for performing recording on a recording medium. More particularly, the invention relates to a recording apparatus having means for detecting the sheet width of a recording medium.

2. Related Background Art

In conventional recording apparatuses, it is a general practice that recordings are performed accompanying the feeding operation of a recording sheet to the recording unit. At this juncture, the recording sheet of a given shape should be at a predetermined position for a normal recording as prerequisite. Whether this condition has been satisfied or not is determined by detecting the difference in the reflective density of the recording sheet and the platen which holds this sheet on the basis of the output level of a sensor of a reflective type and others in use for the purpose. Therefore, the presence of the recording sheet is discriminated by examining whether the output level of such a sensor exceeds a given threshold value or not.

As a method of the kind, there is, for example, disclosed in Japanese Patent Laid-Open Application No. 56-150556, an apparatus for detecting the sizes of recording sheets, in which the light emitting element and light receiving element are arranged to travel along a scale provided in the width direction of a recording sheet for detecting the sheet width.

There is also disclosed in U.S. Pat. No. 4,265,556 a structure such that a sheet width detecting scanner is mounted on a carriage having an ink head for the performance of the sheet width detections.

However, in the conventional sheet width detection, the threshold value is set at a predetermined level in advance for the fiducial sensor output to discriminate the presence of a recording sheet. Consequently, if the aforesaid level of the sensor output should be varied due to any characteristic difference of an individual reflective sensor and others or due to changes brought about by elapsed time or the like, the reflective density of the aforesaid recording sheet should be lower than the anticipated value, or the reflective density of the aforesaid platen should be higher than the anticipated value, there might be some cases that the area where the recording sheet is supposed to be present, that is the position of this sheet, is erroneously detected.

SUMMARY OF THE INVENTION

Now, with a view to solving the above-mentioned problems encounterd in the conventional technique, the present invention is designed, and it is the object of the invention to prevent any erroneous detection of a recording sheet and to detect accurately the positions of both ends which constitute the area where the recording sheet is to be present.

In order to achieve the object such as this, there are provided for a recording apparatus according to the present invention:

measuring means for capable of measuring the luminous energy of a recording medium and means for supporting the recording medium;

means for holding data on the basis of the reflected luminous energy of the means for supporting the recording medium and data on the basis of the reflected luminous energy of the recording medium measured by the aforesaid measuring means; and means for setting a threshold value which can be utilized for determining the boundary between the aforesaid recording medium and aforesaid holding means in accordance with the aforesaid both data.

Also, a recording method according to the present invention for the achievement of the object mentioned above includes the following step of:

measuring the reflected luminous energy of means for supporting the recording medium using measuring means;

measuring the reflected luminous energy of the recording medium using measuring means;

setting a threshold value which can be utilized for determining the boundary between the aforesaid recording medium and aforesaid holding means in accordance with the value on the basis of the reflected luminous energy of the means for supporting the recording medium and the value on the basis of the reflected luminous energy measured as above; and detecting a recordable area in which a recording is possible on the recording medium by comparing the aforesaid threshold value thus set and the measured value of the measuring means, and performing recording in the aforesaid recordable area.

With a structure or a method such as described above, it is possible to perform stable recordings for recording media having different reflection factors and at the same time, to avoid any possibility that a recording is erroneously conducted on the platen side by the changes due to elapsed time with respect to the detection capability of a sensor which serves as measuring means as well as by the changes due to elapsed time with respect to the platen which serves as means for holding the recording medium.

DETAILED DESCRIPTION OF THE PREFERRED EMBODIMENTS

Hereinafter, using the accompanied drawings the description will be made of an embodiment in which the aforesaid means are applied to a recording apparatus.

Figure 1:
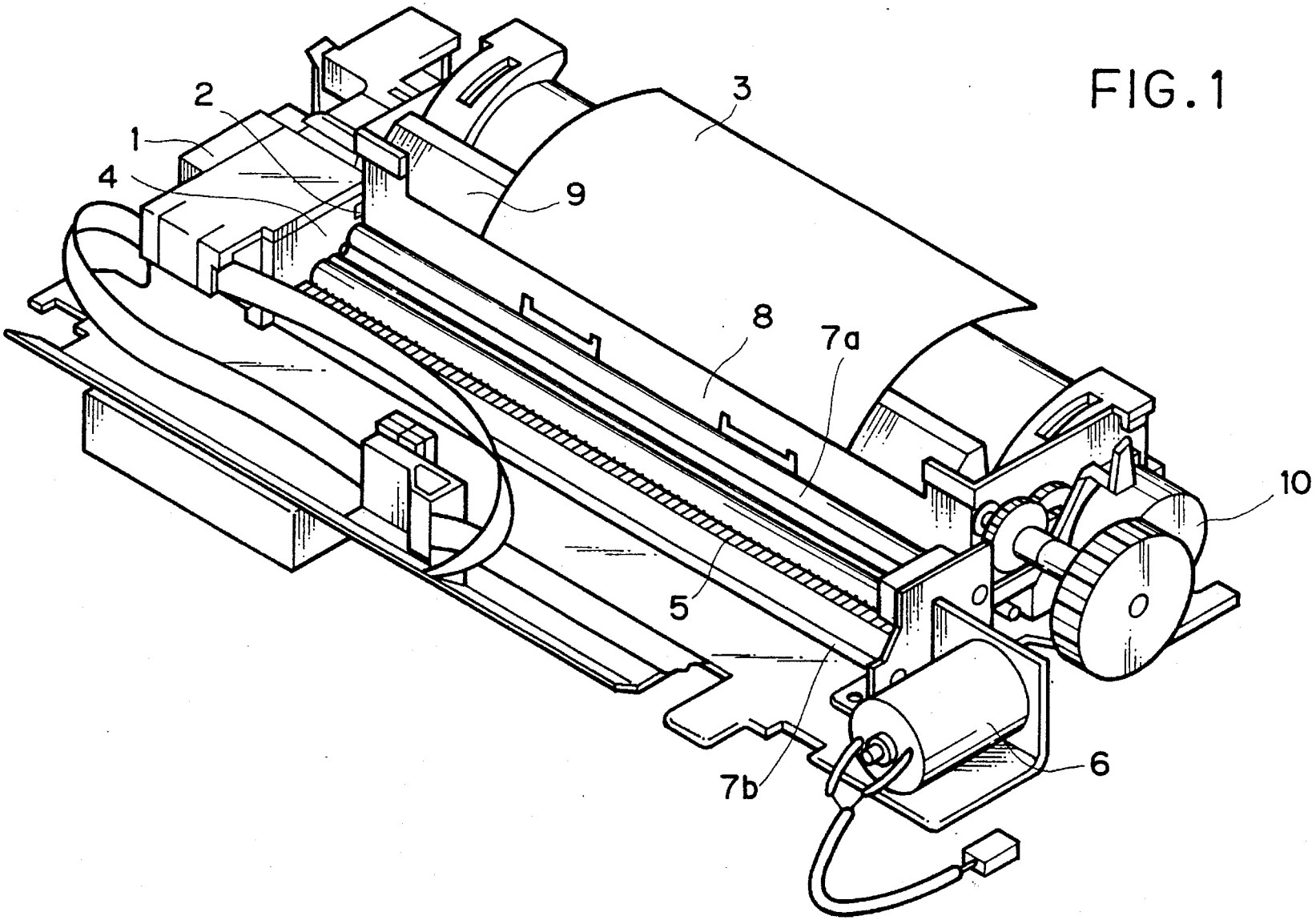
FIG. 1 is a perspective view showing an embodiment of an ink jet recording apparatus according to the present invention.

FIG. 1 is a perspective view schematically showing the structure of a recording apparatus according to an embodiment of the present invention.

In FIG. 1, a reference numeral 1 designates a recording head serving as recording means having a plurality of ink discharging ports for performing recording onto the recording sheet 3 which is a recording medium; also, 2, a reflective sensor serving as detection means (measuring means) for detecting the position (boundary) of the recording sheet 3 which is a recording medium. This recording head 1 and the reflective type sensor 2 are mounted on the front part of a carriage 4 serving as carrier means which will be described later.

The discharging energy generating element of the recording head 1 which serves as the aforesaid recording means causes ink to be discharged from the discharging port by applying energy to ink in accordance with the recording signals transmitted from the main body of the apparatus. For a method of the kind, there is the one using the element capable of applying pressure to ink mechanically as a discharging energy generating element such as a piezoelectric element or the one provided with means for generating thermal energy as an energy generating element (electrothermal transducer, laser light, or the like, for example) so that ink is caused by this thermal energy to change its states. Particularly, according to the latter method, it is possible to obtain a higher density of recording as well as to implement highly minute recordings, and there is also an advantage that with such a method these can be easily attained.

The carriage 4 with the aforesaid recording head 1 and the reflective type sensor 2 mounted thereon is driven by a carriage motor 6 through a carriage belt 5 to travel along the carriage shafts 7*a* and 7*b* reciprocally. Accompanying this reciprocal motion, the recording for a one-line portion by the recording head and the position of the recording sheet 3 are detected.

Also, the aforesaid recording sheet 3 is fed by a feed roller (not shown) driven by a sheet feed motor 10. The recording area of the aforesaid sheet 3 facing the recording head 1 is regulated by a pressure plate 8 for the sheet which is a recording medium and a platen 9. The recording sheet 3 for which recording has been completed is exhausted to the upper part of the apparatus.

Figure 2:
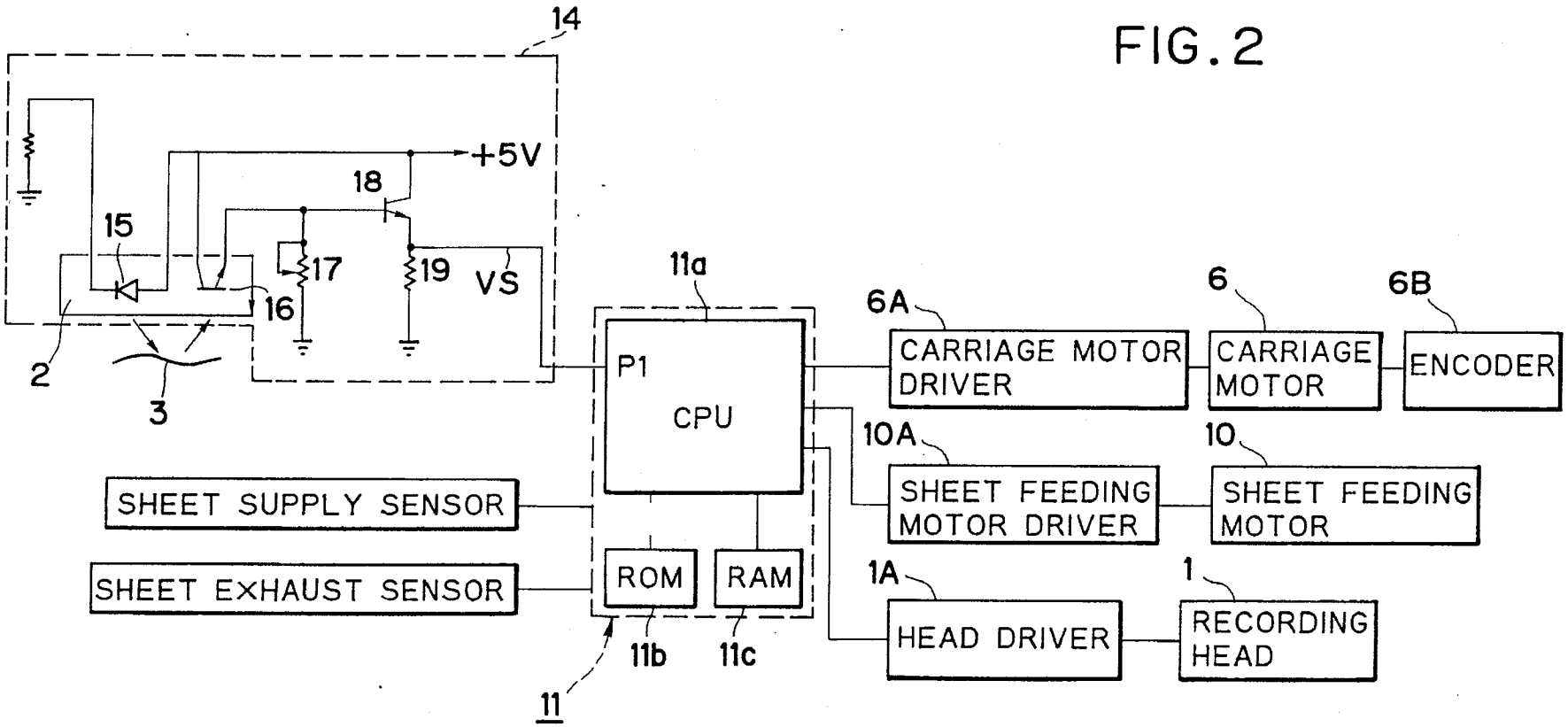
FIG. 2 is a block diagram showing the principal structure for controlling the aforesaid apparatus.

FIG. 2 is a block diagram showing the structure of the principal control system for the aforesaid recording apparatus.

In FIG. 2, a reference numeral 11 designates a control unit comprising a CPU 11*a*, ROM 11*b*, and RAM 11*c*.

The aforesaid CPU 11*a* is a central arithmetic processing unit to read programs and various data from the ROM 11*b* and others which will be described later, to execute required operations and judgments, and to conduct driving controls of the entire system of the apparatus by outputting various control signals in accordance with the control program.

The aforesaid ROM 11*b* is a memory dedicated for reading only and stores various programs and various pieces of information for controlling the aforesaid CPU 11*a* as shown in the flowchart which will be described later.

The aforesaid RAM 11*c* is a random access memory comprising a working area where the instructed data and the results of the operations by the aforesaid CPU 11*a* are provisionally stored, the text area where various data are reserved, and others.

The reflective type sensor 2 which serves as the aforesaid detecting means 14 detects the difference (difference in reflected luminous energy) in the reflection densities of the recording sheet 3 and platen 9, and detects the positions of both ends of the recording sheet 3. This sensor is connected to the analogue input port P1 of the CPU 11*a*. (The CPU 11*a* detects the aforesaid signal (density difference) and also detects the area where the recording sheet 3 is present, that is, the position of the recording sheet 3, by allowing the aforesaid sensor 2 to scan in the sheet width direction with the traveling of the carriage 4.) The carriage motor 6, sheet feed motor 10 and recording head 1 are driven by the carriage motor driver 6A, sheet feed motor driver 10A and head driver 1A when the control signals are transmitted from the CPU 11*a*, respectively. Also, an encoder 6B detects the amount of revolution of the carriage motor 6, and the CPU 11*a* detects the position of the carriage by this amount. Also, the sensor 2 comprises a light emitting element 15 and a light receiving element 16, and at the time of empty scanning in FIG. 4, the rays of light from the light emitting element 15 are reflected by the recording sheet 3 to enter the light receiving element 16. Then, in the present embodiment, the light receiving element 16 changes its photo-current in accordance with the inputted luminous energy. By detecting the changes of this photo-current, the kinds of recording medium and the width of the recording medium can be discriminated.

Also, detecting means has a circuit for converting photo-currents into voltages in order to detect changes in the photo-current.

In FIG. 2, the micro-current (approximately 200 μA) generated by the light receiving element 16 is converted into the voltage by a volume 17 and then impedance conversion is conducted in the transistor 18 and emitter resistance 19 for the connection to an analogue-digital conversion input port P1 of the CPU 11A. The CPU 11*a* also controls a motor 6 for reciprocal traveling of the carriage 4 and stores the output voltage from the sensor 2 in RAM (storage element) 11*c* after giving A/D conversion for each of a given amount of the carriage traveling.

Also, the CPU sets a threshold value from the stored data for detecting the width of a recording medium as described later.

Figure 3:
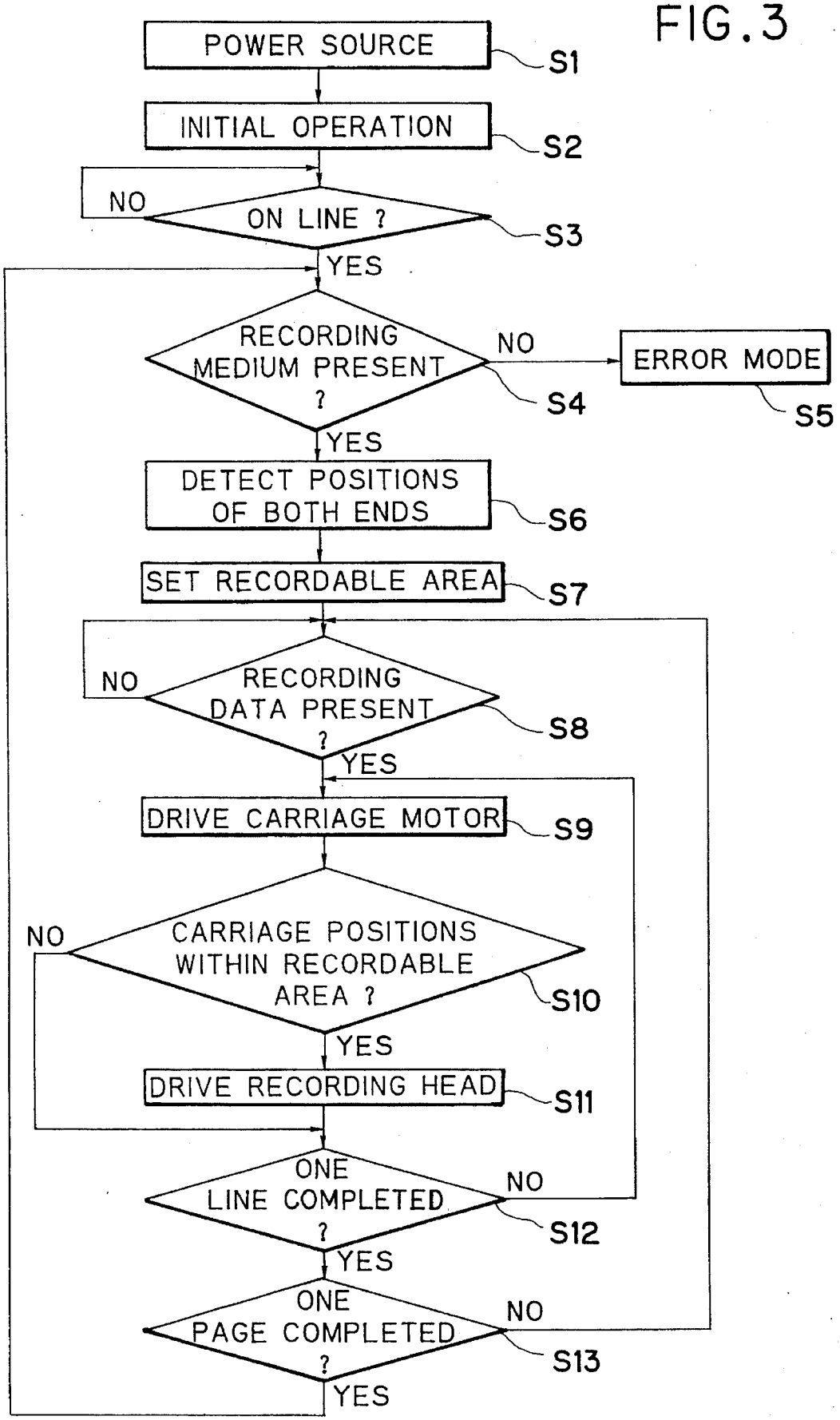
FIG. 3 is a flowchart showing the processing procedures of a recording process according to an embodiment of the present invention.
Figure 4:
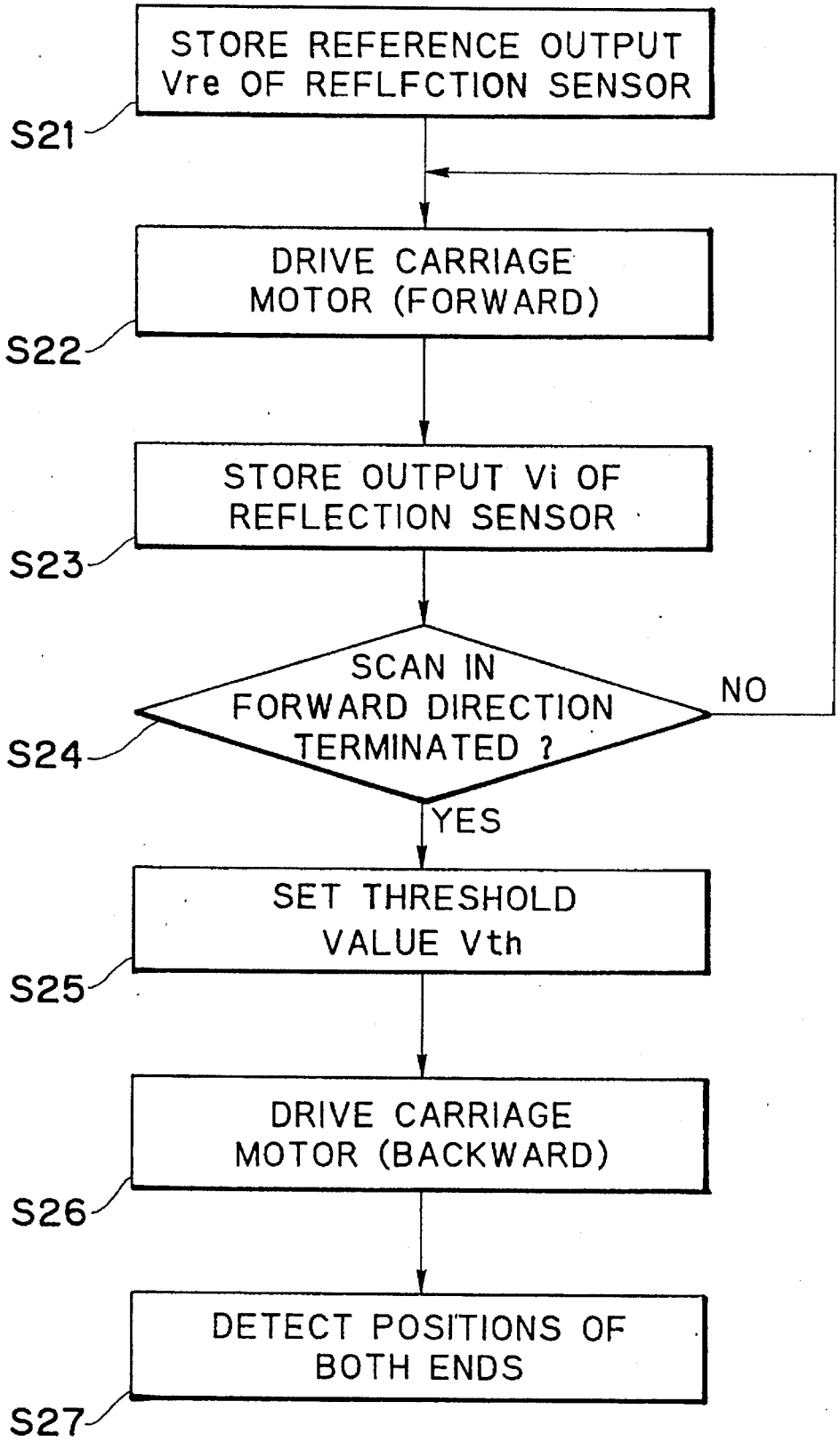
FIG. 4 is a flowchart showing the recording process procedure characterized by the present invention in the aforesaid processing procedures.

FIG. 3 is a flowchart showing the processing procedures for the recording operation by an embodiment according to the present invention. FIG. 4 is a flowchart showing the processing procedure for detecting the positions of the both ends of a recording sheet characterized by the present invention.

At first, in step S1, when the power source is turned on, the initial operations are executed in step S2 including the initialization of the RAM 11*c* and the detection of the home position of the carriage 4 in the aforesaid control unit 11. Then, in step S3, whether the present apparatus is in the on-line state with its host computer and others or not, that is, whether the recording data is receivable or not, is examined, and if it is found to be on-line state, the process will proceed to step S4.

In the step S4, whether the recording sheet 3 is mounted on the recording apparatus or not is ascertained by the use of the sheet feed sensor. Here, if it is determined that no recording sheet 3 is mounted, the process will proceed to the step S5 in which an error mode is set up. On the contrary, if it is determined that a recording sheet 3 is present, the carriage 4, with the reflective type sensor 2 being mounted, travels reciprocally along the carriage shafts 7*a* and 7*b* in step S6; thus detecting the left-end position and right-end position of the recording sheet 3 by comparing the threshold value, which will be defined by the procedure to be described later, and the output signals of the aforesaid sensor 2 and the encoder 6*b* detected by the control unit 11. Then, in step S7, the recordable area is established on the basis of the data regarding the left-end position and right-end position of the aforesaid recording sheet 3; thus, the process will proceed to step S8.

Next, in step S8, whether the recording data are received or not is examined. If it is found that the data have been received, the carriage motor 6 is driven in step S9, and in step S10, whether the position of the carriage 4 is within a recordable area or not is determined. Here, if the carriage 9 has been found to be in the recordable area, the process will proceed to step S11 to drive the recording head 1; hence performing the recording in the aforesaid data signals. On the contrary, if the position of the carriage 9 has been found to be in the area other than the recordable area, the recording head 1 is not driven, and the process will proceed to step S12. Thus, it is possible to prevent any recording from being given to the platen 9 and avoid causing the platen 9 to be stained. In this way, it is possible to protect a recording sheet 3 from any possible stains caused by the platen 9 which would otherwise be stained.

Then, in step S12, whether the one-line portion of the recording data has been recorded or not is examined. Here, if the one-line portion of the recording data is yet to be recorded, the process will return to the step S9. On the contrary, if the one-line portion of the recording data has been recorded, the process will proceed to step S13.

In the step S13, whether the one-page portion of the recording data has been recorded or not is examined. Here, if the one-page portion of the recording data is yet to be recorded, the process will return to the step S8. On the contrary, if the one-page portion of the recording data has been recorded, the process will return to the step S4, and in the step S6, the positions of both ends of the recording sheet 3 are detected; thus thereafter following the flowchart, the same processes will be repeated.

In this respect, according to the procedures described here regarding the detection of the both-end positions, such detection at the positions of both ends is performed once per a recording medium. However, it may be possible to perform such detection per line or per given number of lines in order to operate recordings on recording media the widths of which may vary.

Now, in conjunction with FIG. 4, the detailed description will be made of an example of the process for setting a threshold value (Vth) for the detection of the positions of both ends of a recording sheet 3, which is characteristics of the present invention.

The both-end positions of the recording sheet 3 which is mounted on the recording apparatus are detected in such a manner that the reflection densities of the aforesaid recording sheet 3 and platen 9 are detected by a reflective type sensor 2 mounted on the aforesaid carriage 4, and a threshold value is correctly set on the basis of the signals resulting from such detections, and that the positions of both ends representing the area where the aforesaid sheet 3 exists are detected in accordance with the threshold value thus defined.

At first, in step S21, a reference output Vre of the aforesaid sensor 2 at the fiducial position of the platen 9 is inputted into the CPU 11*a* through the analogue input port P1, and is stored in the RAM 11*c* after its A/D conversion by an A/D converter (not shown) installed in the CPU 11*a*.

Next, in step S22, the carriage motor 6 is driven to enable the carriage 4 to scan while traveling in the forward direction along the carriage shafts 7*a* and 7*b*, and in step S23, the output Vi of the aforesaid sensor 2 is sampled, which is stored in the RAM 11*c* after A/D conversion by the aforesaid A/D converter (not shown).

When the scanning by the aforesaid carriage 4 in the forward direction is terminated (step S24), the threshold value Vth, which will become fiducial for making the judgment of the presence and position of the recording sheet 3, is set in accordance with the outputs Vre, and Vi of the aforesaid sensor 2. As a setting method of the threshold value Vth, it is desirable to define an intermediate value between the reference output Vre at the platen position and Vi from the recording medium as the Vth in consideration of both the changes in the reflection factor of the recording medium and the reflection factor of the platen. However, when it is desirous to avoid recording on the platen side by all means, the Vth should be made slightly greater than such intermediate value even if no recording can be performed onto a recording medium having a low reflection factor. Now, next, in step S26, the carriage motor 6 is driven to enable the carriage 4 to scan while traveling in the backward direction and then the presence of the recording sheet 3 is determined by detecting whether the output of the aforesaid sensor 2 has exceeded the value Vth; thus detecting the positions of both ends of the area where the aforesaid sheet 3 exists.

In the present embodiment, while the value Vth is defined by the two values, the output of the sensor at its fiducial position and the detected value on the recording medium, it may be possible to perform a plurality of detections at given intervals by scanning in the width direction of a recording medium by the use of sensor in accordance with the steps S22 and S23 in FIG. 4 shown earlier. At first, in an area where only the platen is detected without any presence of recording sheet, the sensor outputs a low voltage Vil which indicates the reflection factor (low) of the platen. Then, entering the area where the recording medium is set, the sensor outputs a high voltage Vih which indicates the reflection factor of the recording medium (higher than that of the platen). After this, when the sensor travels through the area where the recording medium is set and enters the platen area again, the output voltage Vi of the sensor becomes a low voltage Vil.

From the voltages thus detected as above, a Vth can be defined on the basis of the averaged values of the higher voltages Vih at several points and of the lower voltages Vil at several points as well. Here, an example is shown in which the detections are performed at given intervals, but it is needless to mention that the detections can be made continuously.

The setting of the threshold value can be performed for each of the recording media (between the steps S4 and S6 in FIG. 3, for example) or it can be performed either for each line or for each of given numbers in order to support the recording medium the reflection factor of which may vary. In this respect, when the detection is conducted for each of the given number of lines, the threshold value, which becomes the judgment base to determine the presence of a recording medium as described above, should be varied to set the required threshold value by utilizing the scanning used for recording. Thus, there is no possibility that recordings are not erroneously given to the platen even if the reflection factor of the platen changes due to elapsed time or the detected voltage of the sensor itself changes due to elapsed time when the light reflection factor differs for each of the recording media and at the same time, it is possible to perform recording to a recording media having a low reflection factor.

Subsequently, the description will be made of the results of the comparative experiments on an apparatus using the method according to the present invention and an apparatus using the conventional method.

With an apparatus having a platen detection voltage fixed at 1.6 V, and a white sheet at 4.7 V, and its intermediate voltage at 3.15 V which is defined to be the threshold voltage at the time of delivery, recordings are performed on the sheets having O.D values of 0.2, 0.3, and 0.4 the detection voltages of which are 4.2 V, 3.2 V and 2.5 V, respectively. Then, the recording sheet having its O.D value of 0.4 with the detection voltage of 2.5 V is erroneously detected because its detection voltage is lower than the threshold voltage of 3.15 V and the judgment is made as no recording sheet being present; thus disabling its recording.

On the other hand, in the apparatus using the method according to the present invention, a threshold value is set after a recording sheet is mounted or for each of given number of lines even when a recording sheet having its O.D value of 0.4 (detection voltage being 2.5 V) such as mentioned above is used for recording.

Therefore, the threshold value for this particular recording is defined at a value between the detection voltage of the platen, 1.6 V, and the detection voltage, 2.5 V, of the sheet having the O.D value of 0.4, that is, an intermediate value of 2.05 V, for example; hence making it possible to perform this recording.

(Another Embodiment)

Also, in the aforesaid embodiment, an ink jet recording method is adopted. However, it is more preferable to adopt a structure in which electro-thermal transducers are energized in accordance with the recording signals to discharge ink from the discharging ports with the film boiling created in ink by the thermal energy generated by the aforesaid electro-thermal transducers.

For the typical structure and principle thereof, it is preferable for its implementation to adopt the fundamental principle disclosed in the specifications of U.S. Pat. No. 4,723,129 and U.S. Pat. No. 4,740,796, for example. This method is applicable both to the so-called on demand type and the continuous type. Particularly, in the case of the on demand type, there is applied at least one driving signal which is provided with a rapid temperature rise exceeding the nuclear boiling in response to the recording information given to the electro-thermal transducers arranged with respect to a sheet or a liquid pass which holds a recording liquid (ink); thus causing the electro-thermal transducers to generate thermal energy. Hence, film boiling is generated on the thermoactive plane of the recording head to form a bubble in the recording liquid one to one efficiently in response to this driving signal. By the growth and contraction of this bubble, the recording liquid is discharged through the aperture of the discharging port to form at least one droplet. It is more preferable to produce this driving signal in the form of pulses; thus making it possible to instantaneously perform the growth and contraction of the bubble appropriately so as to effectuate the discharging of recording liquid with particularly desirable responsibility.

For this pulse type driving signals, those disclosed in the specifications of U.S. Pat. No. 4,463,359 and U.S. Pat. No. 4,345,262 are suitable.

In this respect, if the conditions disclosed in the specification of U.S. Pat. No. 4,313,124 for the invention regarding the ratio of temperature rise on the thermoactive plane mentioned above, it is possible to perform an excellent recording in a better condition.

As the structure of the recording head, the present invention includes the structure having the thermoactive portion arranged in the bending region using the configuration disclosed in the specifications of U.S. Pat. No. 4,558,333 and U.S. Pat. No. 4,459,600 besides a combination of the discharging ports, liquid passes, electro-thermal transducers (linear liquid passes or rectangular liquid passes) such as disclosed in each of the above-mentioned specifications.

Also, the present invention is still effectively applicable even if the structure is made on the basis of Japanese Patent Laid-Open Application No. 59-123670 disclosing a structure in which a common slit is arranged for a plurality of electro-thermal transducers as the discharging port of each electro-thermal transducer thus provided, and also on the basis of Japanese Patent Laid-Open Application No. 59-138461 disclosing a structure in which the aperture is arranged in relation to the discharging ports for absorbing pressurized waves of thermal energy. In other words, these structural arrangements are possible because recordings can be performed reliably and efficiently according to the present invention irrespective of the modes of the recording heads to be adopted.

Furthermore, to the full-line type recording head having a length corresponding to the maximum width of the recording medium on which the recording apparatus can perform its recording, the present invention is effectively applicable.

For such a recording head, there may be a structure to attain the required length by combining a plurality of recording heads or a structure to attain such a length by a single recording head which is integrally constructed itself. In this case the detecting sensor can be arranged either for the entire width or for the area where the end portion of a recording medium should be positioned, or the structure may be made to allow only the sensor to scan separately from the head.

In addition, the present invention is effectively applicable not only to the serial type recording apparatus exemplified above, but also to the recording head fixed to the carriage in the apparatus or a freely exchangeable chip type recording head for which electrical connections and ink supply from the main body of the apparatus are possible by installing the recording head on the carriage therein, or a cartridge type recording head having the ink tank integrally provided for the recording head itself.

Also, it is preferable to add a recovery means, preliminarily auxiliary means, and the like provided for the recording head as constituents of a recording apparatus according to the present invention because with these constituents, the effects of the present invention becomes more stable. To mention specifically, these constituents are a capping means for the recording head, cleaning means, compression or suction means, electro-thermal transducers or exothermic elements independent thereof or preliminary heating means provided by the combination thereof. It is also effective to provide a preliminary discharging mode which performs preliminary discharging aside from the discharging for the regular recording.

Also, for the kind and number of the recording heads to be mounted on a carriage, it may be possible to provide only one head for a single ink color, for example, or a plurality of heads for different recording colors or ink densities. In other words, as a recording mode of the recording apparatus, the present invention is extremely effective in a recording apparatus which is provided with the recording head formed integrally or by a combination of a plurality of heads for recoloring with different colors or at least one for full-colors by mixing colors besides a recording mode for one major color such as black.

In the embodiments of the present invention set forth above, the description has been made of the ink which is a liquid, it may be possible to use the ink which is solidified at room temperature or less, or liquefied when the signal is given for recording use because in the ink jet method a temperature control is generally practiced so that the ink viscosity is kept within a range of stable discharging by adjusting the temperature of the ink itself in a range from 30° C. or more to 70° C. or less. Furthermore, the present invention is suitably applicable to the use of the ink which has a nature that it is liquefied only by thermal energy or of any other types of the ink which can beliquefied by the thermal energy generated in response to the recording signals for the liquid ink discharging, or the ink which begins to be solidified just before reaching the recording medium while preventing any temperature rise due to the thermal energy by way of its positive energy application to changing the states of ink from solid to liquid or using the ink which is solidified for the prevention of its evaporation if it is left intact.

The ink to be used in a case such as this may be maintained in a mode where it is held in the concavities of a porous sheet or through holes in a solid or liquid state for the electro-thermal transducers as disclosed in Japanese Patent Laid-Open Application No. 54-56847 or Japanese Patent Laid-Open Application No. 60-71260. The most effective method among those applicable to each of the inks mentioned above is the one which can be implemented with the aforesaid film boiling method.

Furthermore, as the mode of the ink jet recording apparatus to which the present invention is applicable, there may be those used for copying machines in combination with readers, facsimile apparatuses having transmitter and receiver, and the like in addition to the image output terminals for a computer or other information processing apparatuses.

As described above, the structure is arranged so that by the use of a reflective type sensor mounted on a carriage as detecting means which reciprocally travels in the width direction of the recording sheet, an optimal threshold value is set for each of the aforesaid sheets in accordance with the reflection densities of the recording sheet and the platen which holds the sheet. Therefore, it becomes possible to prevent any erroneous detections of the recording sheets and at the same time, to detect the area where the recording sheet is present, that is, the positions of both ends of the recording sheet, assuredly without being affected by the difference in the individual output of the aforesaid reflective type sensor, the changes due to elapsed time, or the like.

What is claimed is:

1. A recording apparatus having detecting means for detecting the presence of a recording medium, the detecting means comprising:

measuring means for measuring the reflective luminous energy of a recording medium and of means for holding the recording medium;

means for holding data indicative of the measured reflective luminous energy of the holding means and data indicative of the measured reflective luminous energy of the recording medium;

determining means for determining whether or not said recording apparatus is capable of receiving data from a data output device; and setting means for setting a threshold value utilized to discriminate said recording medium and said holding means on the basis of both of said data, the setting means performing setting in a condition that said determining means determines that said recording apparatus is capable of receiving data from said data output device.

2. A recording apparatus according to claim 1, wherein said measuring means is arranged on a carriage on which a recording head for performing recording to the recording medium is mounted, and said carriage scans in a direction intersecting the feeding direction of the recording medium.

3. A recording apparatus according to claim 2, wherein said recording head is an ink jet recording head which performs recording by discharging ink.

4. A recording method for performing recording on a recording medium, comprising the steps of:

measuring the reflective luminous energy of the recording medium;

measuring the reflective luminous energy of means for holding the recording medium;

setting a threshold value utilized for determining the boundary between the recording medium and said holding means by a value on the basis of the reflective luminous energy of said holding means and a value on the basis of the reflective luminous energy of the recording medium measured as stated above, the setting step being performed in a condition that data is capable of being received through a data output device; and performing recording at an area where said recording medium is present, said area being determined by comparing the threshold value set as stated above and the measured values.

5. A recording method according to claim 4, wherein the step of measuring the reflective luminous energy of said means for holding the recording medium, the step of measuring the reflective luminous energy of the recording medium, and the step of setting said threshold value are executed at each time recording media are replaced.

6. A recording method according to claim 4, wherein measurement points measured in the step of measuring the reflective luminous energy of said means for holding the recording medium and in the step of measuring the reflective luminous energy of the recording medium are plural, respectively.

7. A recording method according to claim 4, wherein said threshold value is set as a mean value of a value on the basis of the reflective luminous energy of said means for holding the recording medium and a value on the basis of the reflective luminous energy of the recording medium.

* * * * *

UNITED STATES PATENT AND TRADEMARK OFFICE

CERTIFICATE OF CORRECTION

PATENT NO. : 5,618,120

DATED : April 8, 1997

INVENTOR(S) : EIJI ISHIKAWA

It is certified that error appears in the above-identified patent and that said Letters Patent is hereby corrected as shown below:

On the title page, item:

[56] REFERENCES CITED

"0266209 10/1987 Euro. Pat. Off." should read --0266209 5/1988 Euro. Pat. Off.--; and
"1228880 9/1989 Japan" should read --1-228880 9/1989 Japan--.

COLUMN 5

Line 20, "the" (first occurrence) should be deleted; and
Line 26, "the" (first occurrence) should be deleted.

COLUMN 9

Line 6, "the" (first occurrence) should be deleted and "beliquefied" should read --be liquefied--.

Signed and Sealed this

Second Day of December, 1997

*Attest:*

Bruce Lehman

BRUCE LEHMAN

*Attesting Officer*

*Commissioner of Patents and Trademarks*